US005522154A

United States Patent [19]

Hoffman et al.

[11] Patent Number: 5,522,154

[45] Date of Patent: Jun. 4, 1996

[54] MULTI-BELT DRYER

[75] Inventors: Richard Hoffman, Chicago; Aleksander Szyszko, Carol Street, both of Ill.

[73] Assignee: M & R Printing Equipment, Inc., Glen Ellyn, Ill.

[21] Appl. No.: 300,391

[22] Filed: Sep. 2, 1994

Related U.S. Application Data

[63] Continuation of Ser. No. 937,472, Aug. 28, 1992.

[51] Int. Cl.[6] ..... F26B 19/00

[52] U.S. Cl. ..... 34/205; 34/218

[58] Field of Search ..... 34/203, 205, 218, 34/217, 216, 149, 162; 432/149; 101/153

[56] References Cited

U.S. PATENT DOCUMENTS 3,713,348 1/1973 Conrad et al. .
3,812,732 5/1974 Conrad .
3,859,865 1/1975 Conrad .
3,972,414 8/1976 Conrad .
4,017,982 4/1977 Goffredo ..... 34/66
4,140,216 2/1979 Conrad .
4,269,650 5/1981 Arai et al. ..... 156/540
4,832,186 5/1989 Conrad .

*Primary Examiner*—Henry A. Bennett
*Assistant Examiner*—Susanne C. Tinker
*Attorney, Agent, or Firm*—Wallenstein & Wagner, Ltd.

[57] ABSTRACT

A dryer for drying printed articles comprising a drying chamber, a plurality of conveyor belts having first and second ends, the conveyor belts located substantially within the drying chamber, a motor adapted to drive the plurality of conveyor belts, and a burner adapted to supply heated air to the drying chamber.

22 Claims, 3 Drawing Sheets

MULTI-BELT DRYER

This is a continuation of copending application Ser. No. 07/937,472 filed on Aug. 28, 1992.

DESCRIPTION

1. Technical Field

The present invention relates to the field of drying. More specifically, the present invention relates to a multi-belt dryer for improved drying of printed articles.

2. Background of the Invention

Printed indicia which are applied to T-shirts and other articles of clothing have become very popular. Boutiques which specialize in selling fanciful indicia, such as pictures, sketches, slogans, college names or sports team names printed on T-shirts and other clothing, are commonly seen in shopping malls. The indicia available at these boutiques can be applied directly to an article of clothing or are available applied to a substrate. Those printed on a substrate are typically sold as iron-ons.

Some of the inks used to print the indicia are liquid-based, typically water or plastisol. These types of inks are conventional in the art, and must be cured and dried so that the ink adheres properly to the article or substrate. Methods for printing indicia using the liquid-based ink are also well-known in the art. Furthermore, the need to cure and dry the inks, and various methods for doing so, are well-known in the art.

One way to cure and dry the ink is to heat it. There have been many types of dryers previously used. The most common are electric or gas dryers. The gas and electric dryers generate heat which cures and dries the ink. While these dryers are effective, they are quite bulky. The dryers are commonly twenty feet in length. If more drying is desired, the length of the dryer is increased. As a result, the dryers take up valuable floor space in a printing facility which could be put to more productive use. The dryer of the present invention reduces the required length of the dryer by using multiple conveyor belts which are arranged atop one another. The article enters the dryer at the top conveyor belt, is transferred to the lower conveyor belts within the dryer, and exits the dryer at the bottom conveyor belt. This arrangement allows for a greater retention time in the dryer while at the same time reducing the dryer length.

SUMMARY OF THE INVENTION

The dryer of the present invention comprises a drying chamber, a plurality of conveyor belts having first and second ends, the conveyor belts located substantially within the drying chamber, a motor adapted to drive the plurality of conveyor belts, and a burner adapted to supply heated air to the drying chamber.

An object of the present invention is to provide a dryer with a reduced length but increased residence time. Another object is to reduce the floor space required by the dryer in a printing operation.

Other advantages and aspects of the invention will become apparent upon making reference to the specification, claims and drawings to follow.

DETAILED DESCRIPTION OF THE INVENTION

Figure 1:
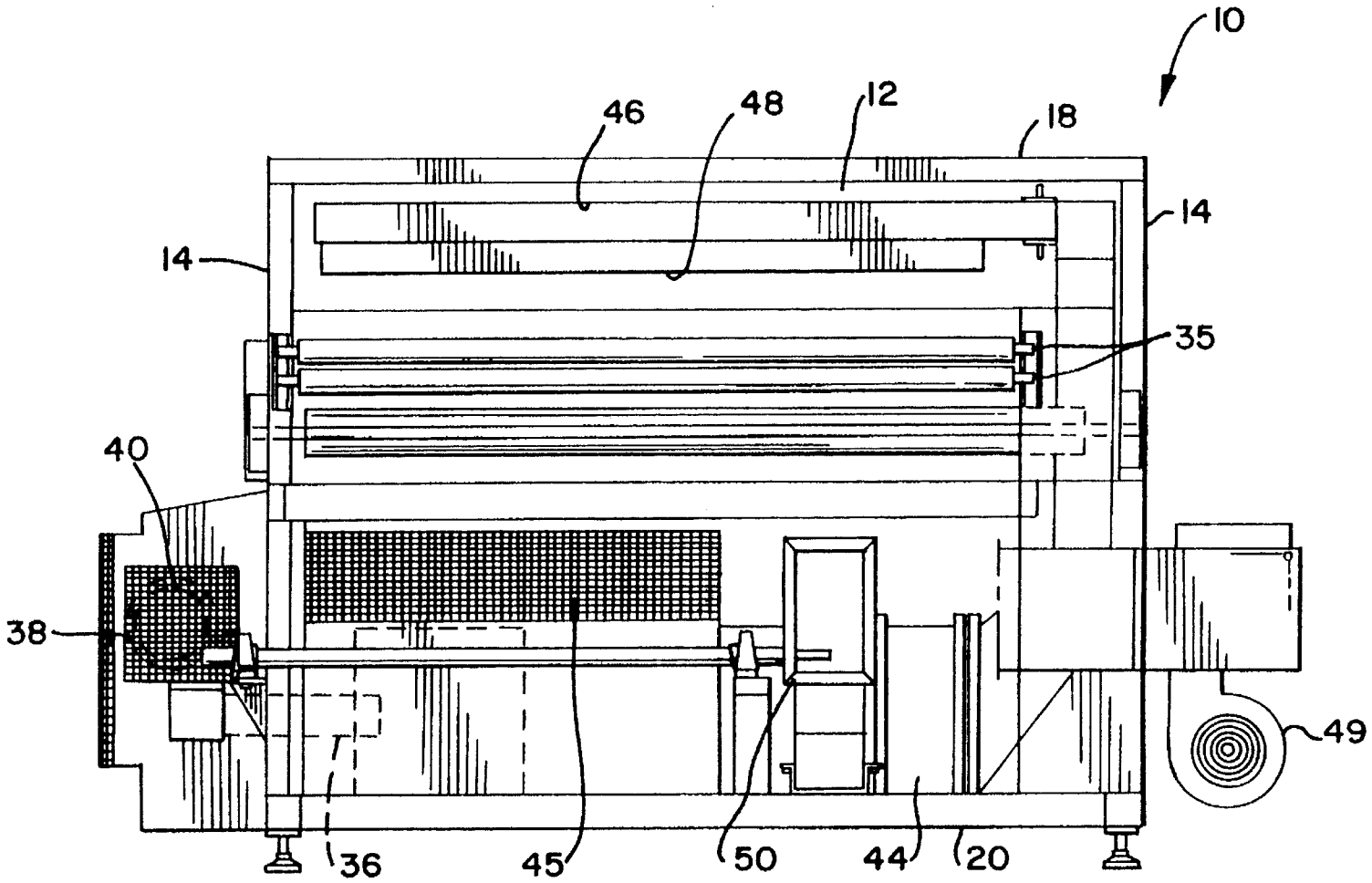
FIG. 1 is an end view of the dryer of the present invention.
Figure 2:
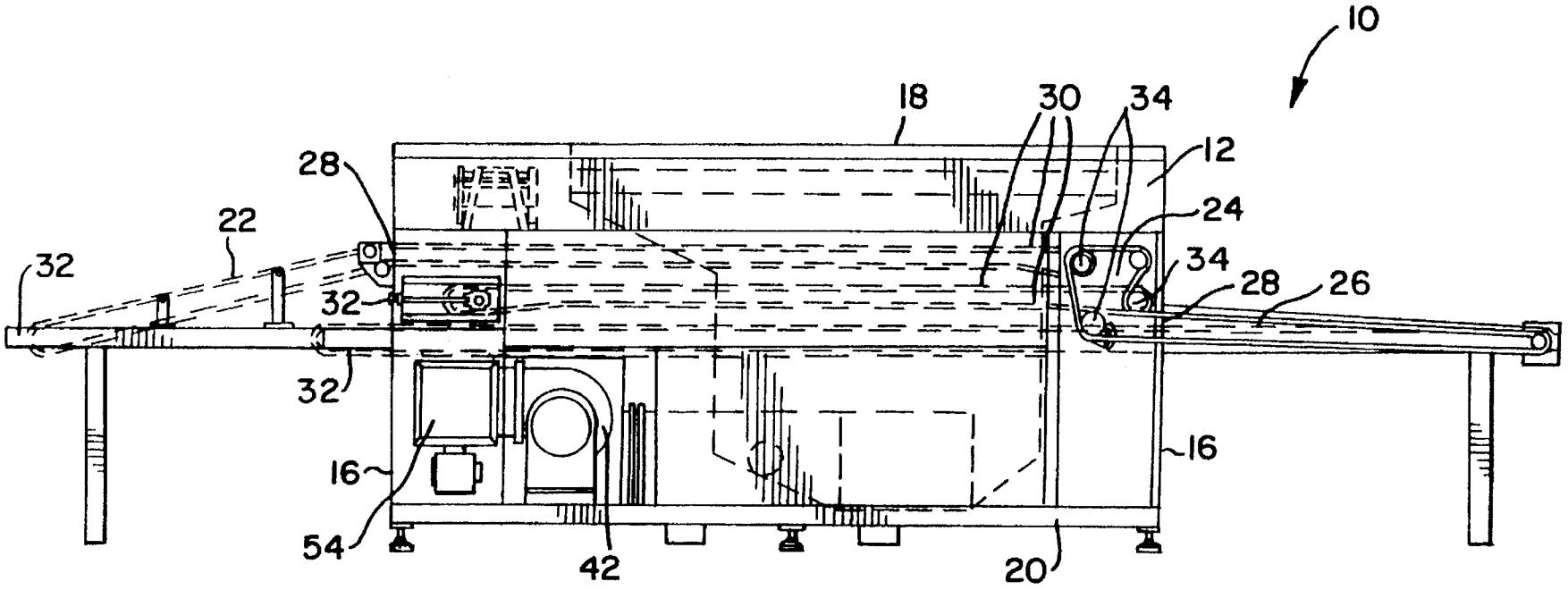
FIG. 2 is a side view of the dryer of the present invention.
Figure 3:
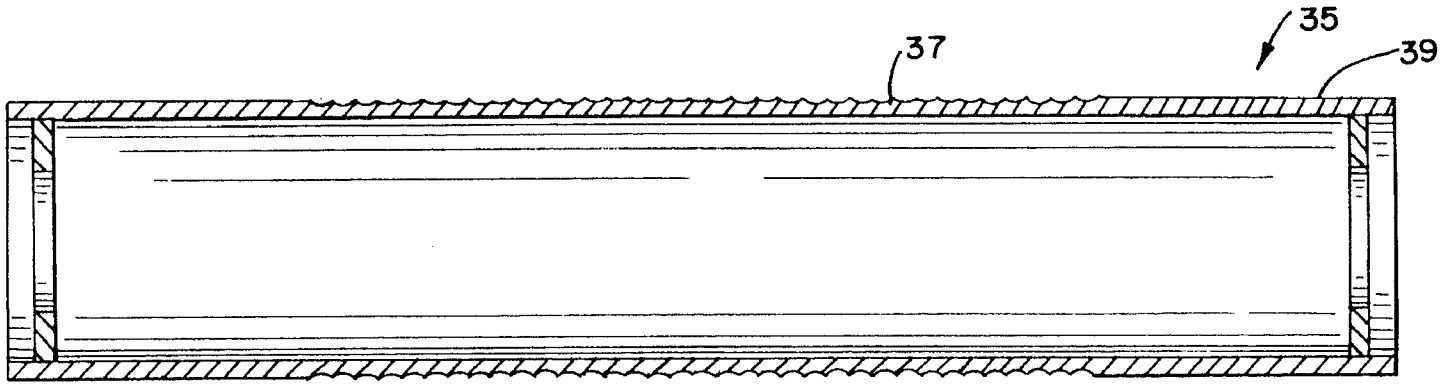
FIG. 3 is a cross-sectional view of an idler roller.
Figure 4:
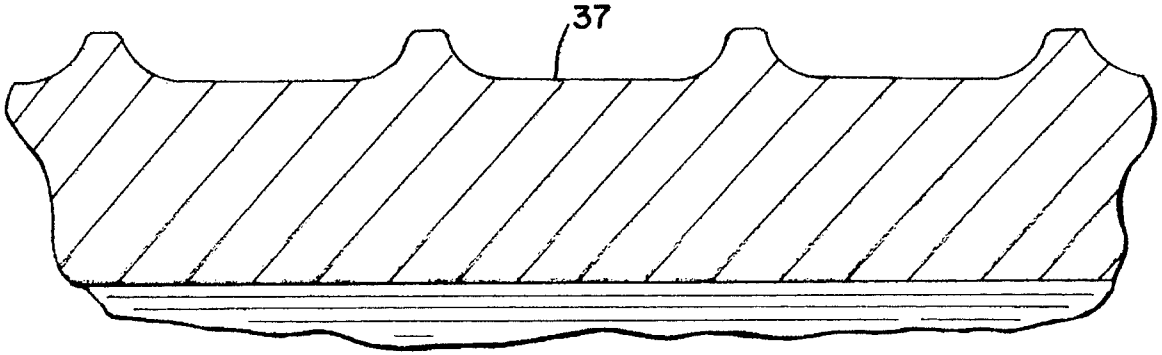
FIG. 4 is an enlarged view of the surface of the idler roller.

While this invention is susceptible of embodiment in many different forms, there is shown in the drawings and will herein be described in detail a preferred embodiment of the invention with the understanding that the present disclosure is to be considered as an exemplification of the principles of the invention, and is not intended to limit the broad aspect of the invention to the embodiment illustrated.

Referring to the drawings, the dryer of the present invention is denoted by reference numeral 10. The dryer 10 comprises a drying chamber 12. The drying chamber 12 is enclosed, by two vertical side walls 14, two vertical end walls 16, a top wall 18 and a bottom wall 20. The drying chamber 12 is approximately ten feet in overall length and between four and six feet in width. It as also approximately five feet high. The dimensions of the drying chamber 12, however, can be varied as desired depending on the amount of drying time required or the size of the articles to be dried.

Extending into the drying chamber 12 is a top conveyor belt 22. The top conveyor belt 22 is partially outside of the drying chamber 12 and acts as a loading area for articles to be dried. The top conveyor belt 22 is made of teflon-coated fiberglass designed to withstand an operating temperature of approximately 550° F. The top conveyor belt 22 extends throughout the length of the drying chamber 12.

Inside the drying chamber 12 is a middle conveyor belt 24. The middle conveyor belt 24 is disposed below the top conveyor belt 22. A bottom conveyor belt 26 is disposed below the middle conveyor belt 24. The bottom conveyor belt 26 extends outside of the drying chamber 12. The portion of the bottom conveyor belt 26 extending outside of the drying chamber 12 acts as an unloading station for dried articles. The middle conveyor belt 24 and bottom conveyor belt 26 are made of the same type of material as the top conveyor belt 22, namely, teflon-coated fiberglass. The end walls 16 of the drying chamber 12 have openings 28 to accommodate the top conveyor belt 22 and the bottom conveyor belt 26.

Each of the top conveyor belt 22, middle conveyor belt 24 and bottom conveyor belt 26 are continuous. The width of each of the conveyor belts varies with the width of the drying chamber 12. At the first ends 30 and second ends 32 of each of top conveyor belt 22, middle conveyor belt 24 and bottom conveyor belt 26 are rollers 34. The rollers 34 at the first ends of the top conveyor belt 22, middle conveyor belt 24 and bottom conveyor belt 26 are operatively engaged with a motor (not shown) to cause the rollers 34 to rotate, thus, driving the conveyor belts.

Each of the top conveyor belt 22, middle conveyor belt 24 and bottom conveyor belt 26 are operatively engaged with an idler roller 35 to keep the conveyors taut and aligned. The idler roller 35 has a plurality of circumferential,grooves 37 in its outer surface 39 to track the conveyors and keep them centered on the rollers 34. The grooves 37 are machined into the outer surface 39 of the idler roller 35 and are 0.280 inches wide. The centers of the grooves 37 are 0.325 inches apart. Depending on the length of the idler roller, which in turn depends on the width of the conveyors, the grooves 37 are discontinued 8 inches from the ends of the idler roller 35 for a 50 inch idler roller, 10 inches for a 62 inch roller, and 12 inches for a 74 inch roller. The idler roller 35 is constructed of a hollow steel tube having an outside diameter of 4 inches and an inside diameter of 3.5 inches. The ends of tube are machined down to 3.687 inches to produce a crowned surface to provide greater control of belt tracking.

Heated air is supplied to the drying chamber by a burner 36. The burner 36 is gas-fired. A combustion blower 38 supplies air to the burner 36 for combustion. A combustion air filter 40 filters air prior to its entering the combustion blower 38. A circulation blower 42 circulates heated air from the drying chamber 12 and mixes it with newly heated air from the burner 36 to a heating duct 44. A lint filter 45 cleans particles from the air from the drying chamber 12 prior to its being recirculated by the circulation blower 42. The heating duct 44 is connected to an air distribution box 46 having outlets 48 for distributing heated air into the drying chamber 12. A blower 49 assists in pushing air to the air distribution box 46.

An exhaust blower 50 and exhaust duct 52 cooperate with the drying chamber 12 to remove excess air from-the drying chamber 12. The amount of air entering the drying chamber 12 should be roughly equivalent to the amount of air being drawn from the drying chamber 12 through the exhaust duct 52.

A typical drying operation commences as follows. An article, such as a T-Shirt or substrate which has been printed in any conventional manner, is placed on the portion of the top conveyor belt 22 extending outside the drying chamber 12. Many such articles can be placed in succession along the top conveyor belt 22. The top conveyor belt is driven by roller 34. The article then enters the drying chamber 12 which is supplied heated air from the air distribution box 46 as described above. The temperature of the heated air in the drying chamber 12 is approximately 350° F. While the article is travelling through the drying chamber 12, the heated air dries the liquid-based ink on the article.

After the article reaches the second end 32 of the top conveyor belt 22, it falls upon the middle conveyor belt 24. The middle conveyor belt 24 travels in the opposite direction to the top conveyor belt 22. Therefore, the article will typically turn upside down as it falls upon the middle conveyor belt 24. The ink should be sufficiently dry from travelling along the top conveyor belt 22 to prevent sticking to the middle conveyor belt 24. Moreover, the teflon coating of the middle conveyor belt 24 prevents the ink from sticking to the conveyor belt. The middle conveyor belt 24 does not extend outside the drying chamber 12 as do the top conveyor belt 22 and bottom conveyor belt 26, but is fully contained within the drying chamber 12.

When the article reaches the first end 30 of the middle conveyor belt 24, it falls upon the bottom conveyor belt 26. The bottom conveyor belt 26 moves in the direction opposite to the middle conveyor belt 24 and the same direction as the top conveyor belt 22. Therefore, the article will turn right-side up as it falls onto the bottom conveyor belt 26. The article travels along the bottom conveyor belt 26 until it exits the drying chamber 12 through opening 28. After the article exits the drying chamber 12, it is removed from the bottom conveyor belt 26, fully dried. If additional drying is required, additional belts can be place inside the drying chamber 12. The height of the drying chamber 12 would then increase, but not the length. This preserves valuable floor space.

While the specific embodiments have been illustrated and described, numerous modifications come to mind without significantly departing from the spirit of the invention, and the scope of protection is only limited by the scope of the accompanying claims.

We claim:

1. A dryer for drying printed articles comprising:

a. a drying chamber;

b. a printed article;

c. a plurality of conveyor belts having first and second ends, wherein said conveyor belts are substantially within said drying chamber and arranged horizontally one above the other, and wherein the printed article lays on any one of the plurality of conveyor belts and is capable of transferring onto a subsequent lower conveyor belt laying in a generally horizontal planar orientation;

d. means for driving said plurality of conveyor belts; and d. means for heating said drying chamber, wherein said heating means comprises a burner.

2. The dryer of claim 1 wherein said driving means comprises:

a. a roller located at each of said first and second ends of said top, middle and bottom conveyor belts; and b. a motor operatively engaged with said rollers located at said first ends of said top, middle and bottom conveyor belts to rotate said rollers.

3. The dryer of claim 1 wherein said heating means comprises:

a. a burner;

b. a burner blower to provide combustion air to said burner;

c. a circulation blower to circulate air heated by said burner;

d. a hot air duct adapted to accept heated air from said circulation blower; and e. an air distribution box connected to said hot air duct having a plurality of outlets to distribute heated air throughout said drying chamber.

4. The dryer of claim 1 wherein said dryer further comprises means for exhausting air from said drying chamber.

5. The dryer of claim 4 wherein said exhausting means comprises:

a. an exhaust duct adapted to extract air from said drying chamber; and b. an exhaust blower adapted to draw air from said drying chamber through said exhaust duct.

6. The dryer of claim 1 wherein said dryer has three conveyor belts.

7. The dryer of claim 6 wherein said three conveyor belts comprise a top conveyor belt, a middle conveyor belt and a bottom conveyor belt.

8. The dryer of claim 1 wherein each of said plurality of conveyor belts is operatively engaged with an idler roller having an outer surface.

9. The dryer of claim 8 wherein said outer surface of said idler roller has a plurality of circumferential grooves.

10. The dryer of claim 9 wherein said grooves are approximately 0.280 inches deep and spaced 0.325 inches from center to center.

11. A dryer for drying printed articles comprising:

a. a drying chamber;

b. a printed article;

c. a top conveyor belt;

d. a middle conveyor belt;

e. a bottom conveyor belt, wherein said top, middle and bottom conveyor belts are substantially within said drying chamber and are arranged horizontally one above the other, and wherein the printed article lays on any one of the conveyor belts and is capable of transferring onto a subsequent lower conveyor belt laying in a generally horizontally planar orientation;

e. a roller located at each of said first and second ends of said top, middle and bottom conveyor belts;

f. a motor operatively engaged with said rollers located at said first ends of said top, middle and bottom conveyor belts to rotate said rollers;

g. a burner;

h. a burner blower to provide combustion air to said burner;

i. a circulation blower to circulate air heated by said burner;

j. a hot air duct adapted to accept heated air from said circulation blower;

k. an air distribution box operatively engaged with said hot air duct having a plurality of outlets to distribute heated air throughout said drying chamber;

l. an exhaust duct adapted to extract air from said drying chamber;

m. an exhaust blower adapted to draw air from said drying chamber through said exhaust duct; and n. an idler roller having an outer surface operatively engaged with each of said bottom, top and middle conveyor belts, said idler roller also having a plurality of circumferential grooves in said outer surface.

12. The dryer of claim 1 wherein a portion of said top conveyor belt and said bottom conveyor belt extend outside said drying chamber.

13. The dryer of claim 12 wherein a portion of said top conveyor belt and said bottom conveyor belt extend outside said drying chamber.

14. A dryer for drying printed articles comprising:

a. a drying chamber;

b. a printed article;

c. a plurality of conveyor belts having first and second ends, wherein said conveyor belts are substantially within said drying chamber and arranged horizontally one above the other, and wherein the printed article lays on any one of the plurality of conveyor belts and is capable of transferring onto a subsequent lower conveyor belt laying in a generally horizontal planar orientation;

d. means for driving said plurality of conveyor belts, wherein said driving means comprises a roller located at each of said first and second ends of said conveyor belts, and a motor operatively engaged with said rollers located at said first ends of said conveyor belts to rotate said rollers; and e. means for heating said drying chamber, wherein said heating means comprises a burner.

15. The dryer of claim 14 wherein said heating means further comprises:

a. a burner blower to provide combustion air to said burner;

b. a circulation blower to circulate air heated by said burner;

c. a hot air duct adapted to accept heated air from said circulation blower; and d. an air distribution box connected to said hot air duct having a plurality of outlets to distribute heated air throughout said drying chamber.

16. The dryer of claim 14 wherein said dryer further comprises means for exhausting air from said drying chamber.

17. The dryer of claim 16 wherein said exhausting means comprises:

a. an exhaust duct adapted to extract air from said drying chamber; and b. an exhaust blower adapted to draw air from said drying chamber through said exhaust duct.

18. The dryer of claim 14 wherein said dryer has three conveyor belts.

19. The dryer of claim 18 wherein said three conveyor belts comprise a top conveyor belt, a middle conveyor belt, and a bottom conveyor belt.

20. The dryer of claim 14 wherein each of said plurality of conveyor belts is operatively engaged with an idler roller having an outer surface.

21. The dryer of claim 20 wherein said outer surface of said idler roller has a plurality of circumferential grooves.

22. The dryer of claim 21 wherein said grooves are approximately 0.280 inches deep and spaced 0.325 inches from center to center.

* * * * *

UNITED STATES PATENT AND TRADEMARK OFFICE

CERTIFICATE OF CORRECTION

PATENT NO. : 5,522,154

DATED : June 4, 1996

INVENTOR(S) : Richard Hoffman et al.

It is certified that error appears in the above-indentified patent and that said Letters Patent is hereby corrected as shown below:

Column 5, Claim 13, line 32, delete "12" and insert --11--.

Signed and Sealed this

Twenty-ninth Day of October 1996

Bruce Lehman

*Attest:*

BRUCE LEHMAN

*Attesting Officer*

*Commissioner of Patents and Trademarks*